US005105201A

United States Patent [19]

Nakase et al.

[11] Patent Number: 5,105,201

[45] Date of Patent: Apr. 14, 1992

[54] GLASS MOUNTED ANTENNA FOR CAR RADIO

[75] Inventors: Kazuhiko Nakase; Moriyoshi Kawasaki, both of Tokyo, Japan

[73] Assignee: Harada Kogyo Kabushiki Kaisha, Tokyo, Japan

[21] Appl. No.: 543,709

[22] Filed: Jun. 26, 1990

[30] Foreign Application Priority Data

Jun. 30, 1989 [JP] Japan ..... 1-168868

[51] Int. Cl.[5] ..... H01Q 1/32

[52] U.S. Cl. ..... 343/715; 343/713; 333/24 C; 333/32

[58] Field of Search ..... 343/715, 713, 711; 455/286, 297; 333/24 C, 32

[56] References Cited

U.S. PATENT DOCUMENTS 4,238,799 12/1980 Parfitt ..... 343/715
4,764,773 8/1988 Larsen et al. ..... 343/715
4,779,098 10/1988 Blaese ..... 343/715

*Primary Examiner*—Michael C. Wimer
*Assistant Examiner*—Hoanganh Le
*Attorney, Agent, or Firm*—Koda and Androlia

[57] ABSTRACT

A glass mounted antenna for car radio including an antenna element having a length that is in a resonant or non-resonant state with respect to FM frequencies, resonance circuits made up with spiral coils and capacitors so as to resonate in the FM band, a band-pass filter that passes only FM signals and no AM signals, and an AM impedance converter having an active element converting high-impedance signals into low impedance signals.

3 Claims, 2 Drawing Sheets

GLASS MOUNTED ANTENNA FOR CAR RADIO

FIELD OF INVENTION

The present invention relates to an AM-FM antenna which is installed on automobiles and more particularly to a through-glass type antenna.

PRIOR ART

In conventional through-glass antenna, capacitor electrodes clamp both sides of a window glass, and signals are passed via electrostatic capacitance of this arrangement.

Problems Which the Present Invention Attempts to Solve

In conventional devices of the type described above, FM signals are coupled through the glass by electrostatic coupling; accordingly, any metal objects in the vicinity thereof will have a great influence. Especially in cases where anti-fog heater wires are installed, the coupling loss becomes extremely large. On the other hand, in cases where FM signals are coupled through glass by electromagnetic coupling, only materials with a high magnetic permeability such as iron, etc., have an influence, and the influence by general metal objects is small. However, in cases where electromagnetic coupling is achieved by setting cylindrical coils to face each other, a certain coil height is required, the device becomes excessively thick, and the structure becomes complicated. As a result, the appearance of the device is poor when mounted on an automobile.

Meanwhile, in cases where AM signals are coupled through glass by means of electrostatic-capacitive coupling as in the conventional devices, there are restrictions on the size of capacitor electrode plates in which the capacitance is limited to 10 pF or less. As a result, the impedance value of the coupling electrostatic capacitance becomes several tens of kilo ohms. If this arrangement is connected to a direct feeder line and thus led to a radio receiver, a large loss (−20 to −40 dB) is generated as a result of capacitance splitting loss caused by the electrostatic capacitance of the feeder line. Consequently, such an arrangement is impractical.

Furthermore, in the conventional devices, there is an additional loss arising from the fact that AM and FM circuits are both present. As a result, the loss increases for both AM signals and FM signals.

SUMMARY OF THE INVENTION

The object of the present invention is to provide a through-glass type antenna used for automobile radios, in which the coupling portion of the device is not excessively thick when the antenna is mounted without opening a hole in the vehicle body, and which has roughly the same sensitivity as a conventional rod-form antenna.

Means to Solve the Problem

The present invention comprises resonance circuits composed of a spiral-form coil and a capacitor and resonate in the FM frequency band, a band-pass filter which passes only FM signals, capacitor electrodes which pass AM signals, and an AM impedance converter.

Function

Since the present invention comprises resonance circuits composed of a spiral-form coil and a capacitor and resonate in the FM frequency band, a band-pass filter which passes only FM signals, capacitor electrodes which pass AM signals, and an AM impedance converter, the antenna can be installed without opening a hole in the vehicle body, and an antenna which has roughly the same sensitivity as conventional rod-form antenna can be obtained without making the coupling portion of the antenna excessively thick.

DESCRIPTION OF THE PREFERRED EMBODIMENT

Figure 1:
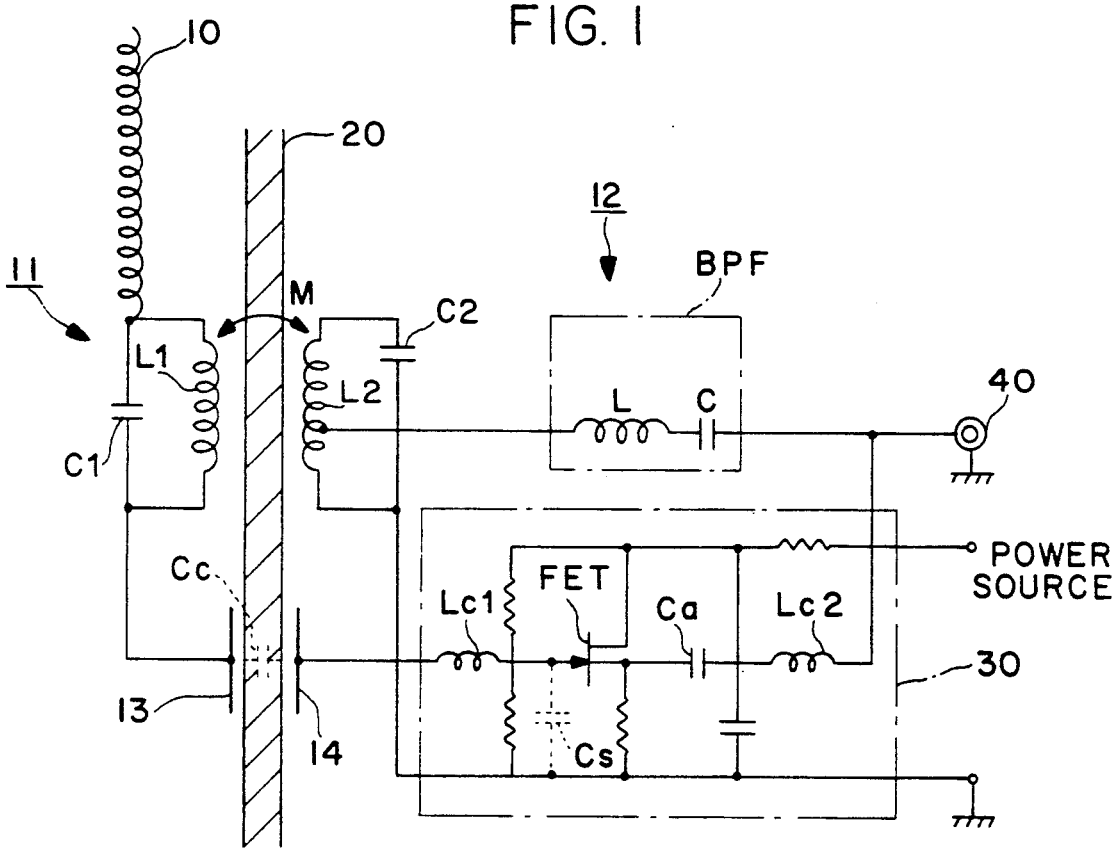
FIG. 1 is a circuit diagram which illustrates one embodiment of the present invention.
Figure 2:
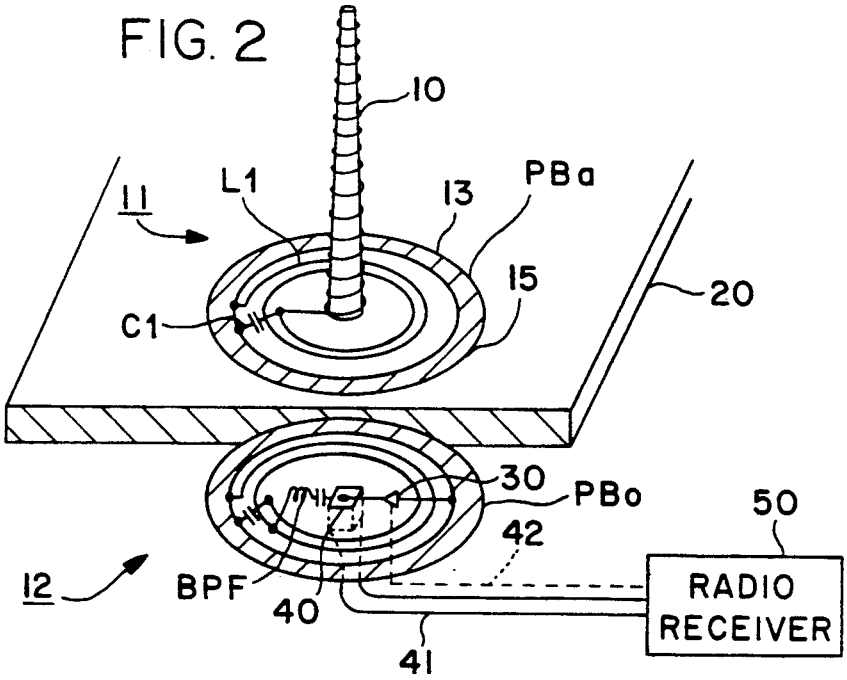
FIG. 2 is an explanatory diagram which illustrates the above embodiment.
Figure 3:
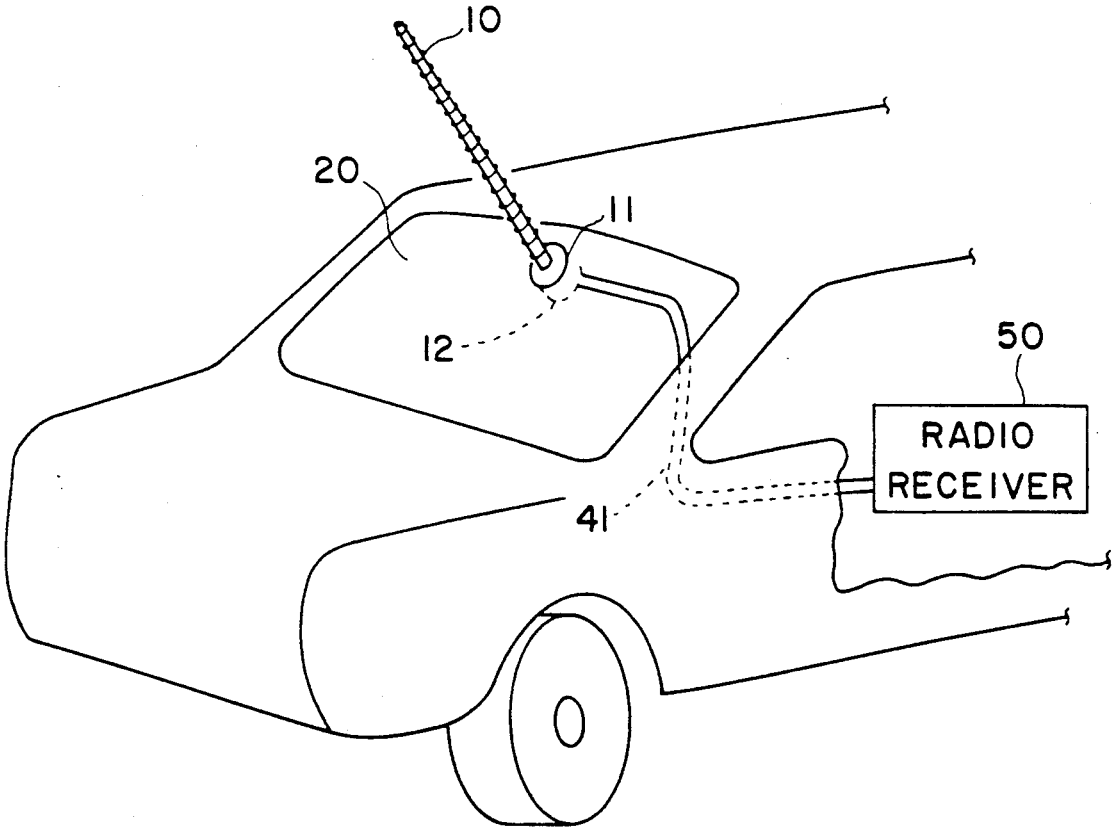
FIG. 3 is an explanatory diagram which shows the embodiment attached to an automobile.

In this embodiment, a helical antenna 10 is made up with a conductive wire wound into helical shape in order to make the length of the antenna as short as possible and is connected to a substrate (PBa) for an antenna-side resonance circuit 11.

The antenna-side resonance circuit 11 includes a spiral-form helical coil L1, a chip capacitor C1 which resonates in the FM frequency band, and a ring-form AM capacitor electrode plate 13. These elements are installed on a single substrate (PBa).

The substrate (PBa) of the antenna-side resonance circuit 11 is bonded to window glass 20 by means of an adhesive sheet 15. The antenna-side resonance circuit 11 and an output-side resonance circuit 12 face each other with the window glass 20 interposed between these circuits 11 and 12.

The output-side resonance circuit 12 includes a spiral-form helical coil L2, a chip capacitor C2 which resonates in the FM frequency band, a ring-form capacitor electrode plate 14, a band-pass filter (BPF), an FET circuit 30, and an output terminal 40. These elements are installed on a single substrate (PBo).

The FET circuit 30 includes a choke coil Lc1 for stopping FM signals, a FEt, a floating capacitor Cs, a capacitor Ca for stopping direct current, and an FM choke coil Lc2. The choke coil Lc1 for stopping FM signals connects the ring-form capacitor electrode 14 of the output-side resonance circuit 12 and the gate input of the FET. The FET converts high-impedance AM signals, which are applied to its gate, into low-impedance signals. Furthermore, power is supplied to the FET circuit 30 from a radio receiver 50 via a feeder line 42.

The helical coil L1 and the chip capacitor C1 as well as the helical coil L2 and the chip capacitor C2 are made up of a spiral-form coil and capacitor. These circuits are examples of resonance circuits which resonate in the FM frequency band.

The band-pass filter BVPF passes FM signals, but for AM signals, the impedance is increased so that there is no loss as a result of AM signals entering the FM circuit. In the above embodiment, the most simple LC series resonance circuits are used.

The two substrates PBa and PBo are covered by waterproof plastic cases (not shown) and fixedly mounted to face each other, by means of adhesive sheets, on both sides of the automobile window glass 20.

The output terminal 40 and radio receiver 50 are connected via a feeder line 41 consisting of a coaxial cable so that AM and FM signals received by the helical antenna 10 are sent to the radio receiver 50.

The length of the helical antenna 10 is determined in a coordinated manner with reference to factors such as balance with automobiles in view of design, avoidance of damages resulting from contact with garages, roadside trees, etc. and the relationship between wind pressure at high speeds and the adhesive strength of the adhesive sheet 15, etc. A length of approximately 50 cm is appropriate for the helical antenna 10.

Next, the operation of the above described embodiment will be described.

For the helical coil L1 and tuning capacitor C1 of the antenna-side resonance circuit 11, the circuit constants are selected so that the circuit 11, including the helical antenna 10, will resonate in the FM frequency band. Similarly, for the helical coil L2 and tuning capacitor C2 of the output-side resonance circuit 12, the circuit constants are selected so that the circuit resonates more or less in the FM frequency band. The helical coils L1 and L2 are electromagnetically coupled with the glass 20 in between. The coupling impedance in this case is M. The band-pass filter BPF is connected to a tap position of the helical coil L2 of the output-side resonance circuit 12, so that the tap position is adjusted and the antenna 10 and feeder line 41 are optimally matched.

The value of the capacitor C of the band-pass filter BPF is set at approximately 10 to 20 pF so that the bandwidth required for FM signals can be maintained; thus, there is a sufficiently high impedance against AM signals, and AM signal loss can be ignored.

The capacitor electrode plates 13 and 14 are installed outside the respective spiral-form helical coils L1 and L2 so that a capacitor Cc is formed. The mutual coupling capacitance is approximately 5 to 10 pF.

In the FET circuit 30 of the output-side resonance circuit 12, FM signals are greatly attenuated by the choke coil Lc1 and the floating capacitor Cs, so that only AM signals are input into the gate of the FET at a high impedance and subsequently outputted from the source side of the FET as low-impedance output signals. These output signals are sent to the output terminal 40, along with the FM output, via the capacitor Ca for stopping the direct current and the FM choke coil Lc2.

The resonance circuits formed by the spiral-form coils L1 and L2 are electromagnetically coupled to each other with the window glass 20 in between so that a double tuning circuit is formed in the FM frequency band.

The matching of the antenna 10 and the feeder line 41 can be optimized in the FM frequency band by adjusting the tap position of the spiral-form coil L2 of the output-side resonance circuit 12.

The capacitor electrodes 13 and 14 are electrostatically coupled to each other with the window glass 20 in between so that AM signals can pass through.

Next, the operation in regard to FM signals will be described.

In the above embodiment, the spiral-form coils L1 and L2 are coupled facing each other, and the coils are formed as flat coils. Accordingly, there is no coil height. Since this arrangement is constructed using the substrates PBa and PBo, the structure is simple, and a device can be flat. As a result, the appearance of the device is good when mounted on a vehicle.

Resonance circuits 11 and 12 which resonate in the FM frequency band are installed on both the antenna side and the output side, so that a double tuning circuit is formed which utilizes electromagnetic coupling. Accordingly, the FM frequency band can be covered, and the coupling circuit can be endowed with broad-band characteristics.

Next, the operation in regard to AM signals will be described.

In the above embodiment, a coupling electrostatic capacitance is formed by the capacitor electrodes 13 and 14, and an impedance converter using FET is inserted into the output end of the coupling electrostatic capacitance, so that high-impedance input signals are outputted as low-impedance output signals and sent in this form to the feeder line 41. Accordingly, a capacitance splitting loss is almost completely eliminated, and practical AM signals are received. Furthermore, since FET is inserted in the AM circuit, the AM system and FM system are separated so that any loss resulting from the co-presence of the AM and FM circuits can be ignored.

Furthermore, it is possible to use an impedance converter utilizing an active element other than the FET instead of FET circuit 30.

In the embodiment above, the capacitor electrodes 13 and 14 are installed in a ring-form on the outside of the respective spiral-form coils L1 and L2; however, it is possible to install the capacitor electrodes 13 and 14 on the inside of the respective spiral-form coils L1 and L2.

In the embodiment, it would also be possible to use a rod-form antenna which has a length that is in a non-resonant state with respect to FM frequencies instead of the helical antenna 10.

EFFECT OF THE INVENTION

According to the present invention, such merits are obtained that in cases where the antenna is installed without opening a hole in the vehicle body, a sensitivity which is roughly the same as that of a conventional rod-form antenna can be obtained without making the coupling portion of the device excessively thick.

We claim:

1. A glass mounted antenna for a car radio comprising:

a first resonant circuit comprising a capacitor in a coil provided on one side of said glass, said first resonant circuit being resonant at an FM broadcast frequency band;

a first ring-formed capacitor electrode provided on said one side of said window glass;

an antenna means electrically coupled to said first resonant circuit and said first ring-formed capacitor electrode;

a second resonant circuit comprising a capacitor and a coil provided on another side of said glass opposing said first resonant circuit, said second resonant circuit being resonant at said FM broadcast frequency band;

a second ring-formed capacitor electrode provided on said another side of said glass opposing said first ring-formed capacitor element;

a band-pass filter means for passing signals in said FM broadcast frequency band coupled to said second resonant circuit; and an AM impedance converter means for converting a high impedance at an AM broadcast frequency band to a low impedance at said AM broadcast frequency band coupled to said second ring-formed capacitor electrode:

whereby signals in said FM broadcast frequency band are passed through said glass by said first and second resonant circuits and to a receiver of said car radio by said band-pass filter and signals at said AM broadcast frequency band are passed through said glass by said first and second ring-formed capacitor electrodes and through said AM impedance converter means to said receiver of said car radio.

2. A glass mounted antenna according to claim 1 wherein said antenna means is a rod-formed antenna.

3. A glass mounted antenna according to claim 1, wherein said antenna means is a helical-form antenna.

* * * * *